United States Patent [19]

Ibrahim et al.

[11] 4,302,948

[45] Dec. 1, 1981

[54] REFRIGERATED DISPLAY CASE HAVING A UNITARY OUTLET GRID

[75] Inventors: Fayez F. Ibrahim, Niles; Elmer Subera, Cassopolis, both of Mich.; William deBruyn, South Bend, Ind.

[73] Assignee: Tyler Refrigeration Corporation, Niles, Mich.

[21] Appl. No.: 73,247

[22] Filed: Sep. 6, 1979

[51] Int. Cl.[3] ..... A47F 3/04

[52] U.S. Cl. ..... 62/256

[58] Field of Search ..... 62/255, 256, 248, 272

[56] References Cited

U.S. PATENT DOCUMENTS

| | | | |
|---|---|---|---|
| 3,129,567 | 4/1964 | Beckwith | 62/256 |
| 3,149,476 | 9/1964 | Beckwith | 62/256 |
| 3,256,799 | 6/1966 | Beckwith et al. | 62/256 X |
| 3,287,929 | 11/1966 | Beckwith | 62/256 |
| 3,304,736 | 2/1967 | Brennan et al. | 62/256 X |
| 3,324,783 | 6/1967 | Hickox | 62/256 X |
| 3,403,525 | 10/1968 | Beckwith et al. | 62/255 X |
| 4,144,720 | 3/1979 | Subera et al. | 62/256 |

*Primary Examiner*—Lloyd L. King

*Attorney, Agent, or Firm*—LeBlanc, Nolan, Shur & Nies

[57] ABSTRACT

A refrigerated display case having at least two outlet air conduits with a unitary grid member covering the outlet openings of such conduits. The display case is formed by a cabinet having an interior display space for holding refrigerated products. A primary air conduit encircles the cabinet and has an outlet opening at one end adjacent to an access opening in the cabinet and an inlet opening at its other end adjacent to the access opening. The inlet and outlet openings of the primary air conduit are aligned so that air leaving the outlet opening is directed across the access opening of the cabinet and received by the inlet opening. A set of evaporator coils are arranged within the primary air conduit for refrigerating the air passing through such conduits. The air is circulated through the primary air conduit by a set of fans. A secondary air conduit extends along the cabinet and is positioned outside of the primary air conduit. The secondary air conduit has an outlet opening for directing air across the access opening of the cabinet. The outlet opening of the secondary air conduit is aligned with and positioned adjacent to the outlet opening of the primary air conduit. A unitary grid member extends across the outlet opening of the primary air conduit and the outlet opening of the secondary air conduit. Due to the temperature differential between the air emitted from the outlet openings there is normally a tendency for condensation to accumulate at the juncture of the two outlet openings. In order to minimize and substantially eliminate such condensation and any resulting frost buildup, in insulating member separates the two air conduits and is either in contact with or actually extended into the unitary grid structure.

8 Claims, 2 Drawing Figures

REFRIGERATED DISPLAY CASE HAVING A UNITARY OUTLET GRID

RELATED APPLICATION

The present application is related to U.S. Patent Application Ser. No. 70,882 to Fayez E. Abraham, entitled MULTIBAND OPEN FRONT REFRIGERATED CASE WITH AIR DEFROST, filed Aug. 29, 1979. The contents of such application is incorporated herein by reference.

BACKGROUND OF THE INVENTION

The present invention relates to a refrigerated display case capable of utilizing a unitary grid structure across the outlet air conduit openings without incurring any detrimental buildup of frost. The designation refrigerated display case is intended to refer both to cases maintained above 32° F., such as dairy and fresh meat cases, and cases maintained below 32° F., such as ice cream cases.

Typically in prior art refrigerated display cases, the outlet openings of the air conduits have been separately constructed with each having its own grid member over the opening. In the upright cases, i.e. those having front access openings, the outlet openings also have been staggered with the primary air conduit outlet opening being lower than the other outlet openings. Even with such formations, a problem that has typically occurred has been a buildup of frost across the outlet openings with such buildup being especially enhanced due to the temperature differential between the air emitted from the different openings. Such temperature differential causes the grid to drop below the dew point and results in an accumulation of condensation and a frost buildup.

In order to minimize such buildup of condensation, each outlet opening and the corresponding grid structure has been totally isolated from the openings and grids of the adjacent conduits. In addition, in order to minimize such condensation, electrical heater wires have been provided adjacent to the outlet openings, such as shown in U.S. Patent Application Ser. No. 876,748 to Fayez Abraham and Arthur Perez, filed Feb. 10, 1978; the subject matter of such application is hereby incorporated by reference.

Unitary grid structures have been utilized in open top refrigerated display cases such as disclosed in U.S. Pat. No. 4,106,305 to Fayez Ibrahim (now known as Fayez Abraham). While not commonly utilized or disclosed, U.S. Pat. No. 3,756,038 to MacMaster et al does disclose a common grid across the outlet openings of the primary and secondary air conduits of an open front display case.

SUMMARY OF THE INVENTION

An object of the present invention is to provide a refrigerated display case having a unitary grid structure across the outlet openings of the primary and secondary air conduits with an insulating mechanism for sufficiently minimizing condensation on the grid so as to eliminate the necessity of utilizing electrical heater wires for avoiding frost buildup.

Another object of the present invention is to provide a refrigerated display case having a unitary grid member extending across the outlet openings of the primary and secondary air conduits with an insulating member separating such outlet openings and contacting the unitary grid for minimizing condensation in the area of the intersection of such openings.

A further object of the present invention is to provide a refrigerated display case having a unitary grid member extending across the outlet openings of the primary and secondary air conduits with an insulating member in contact with the unitary grid member for sufficiently isolating the two portions of the unitary grid in order to substantially eliminate condensation when the temperature differential between the air leaving the outlet opening of the primary air conduit and the air leaving the outlet opening of the secondary air conduit is approximately 10° or greater.

Still another object of the present invention is to provide a refrigerated display case having a primary refrigerated air conduit, a secondary air conduit and a tertiary ambient air conduit with a unitary grid structure extending across the outlet openings of all three air conduits with an insulating member being in contact with such unitary grid member for substantially minimizing any buildup of condensation on such grid member.

The above noted objectives are achieved by the construction of the display case in accordance with the present invention. The refrigerated display case is formed in a cabinet that has an interior display space for holding the refrigerated products. The cabinet has an access opening for enabling access to the products within the interior display space. A primary air conduit encircles the cabinet and has an outlet opening at one end adjacent to the access opening of the cabinet and an inlet opening at its other end adjacent to the opposite side of the access opening of the cabinet. These inlet and outlet openings are aligned so that air leaving the outlet opening is directed across the access opening of the cabinet and received by the inlet opening of the primary air conduit. Located within the primary air conduit is a set of evaporator coils for refrigerating the air passing through such conduit. The air is circulated through the primary air conduit by at least one fan. Normally, there would be two, three or four fans for circulating the air through the primary air conduit with the number of fans depending on the lateral length of the conduit.

A secondary air conduit extends along the cabinet and is positioned outside of the primary air conduit. This secondary air conduit has an outlet opening for directing air across the access opening of the cabinet. The outlet opening of the secondary air conduit is aligned with and positioned adjacent to the outlet opening of the primary air conduit.

The secondary air conduit can extend either partially around the cabinet or can entirely encircle the cabinet in the same manner as the primary air conduit. In the prior of the two mentioned embodiments, the secondary air conduit would commence at a location immediately after the set of fans in the primary air conduit so as to draw a portion of the air passing through the fans but which has not passed through the evaporator coils. In such an embodiment, on the return air side of the display case there is only a single inlet opening leading into the primary air conduit and it is a portion of this return air which is drawn into the secondary air conduit that extends only partially around the cabinet. In the alternative embodiment, the secondary air conduit extends around the cabinet the same length as the primary air conduit and there is a separate air inlet opening, which is adjacent to the inlet opening of the primary air conduit, for air to enter the secondary air conduit. Either of these embodiments can be incorporated into an open top or an open front display case.

Arranged across the outlet openings of the primary air conduit in the secondary air conduit is a unitary grid member. An insulating member separates the two outlet openings and contacts the unitary grid member for minimizing condensation in the area of the intersection of the outlet openings. Such condensation typically arises due to the differential in the temperature of the air emitted from the outlet openings. Thus, by substantially isolating the two outlet openings the condensation can be substantially eliminated. The buildup of condensation occurs since the intersecting portion of the grid, that portion between the outlet openings of the two air conduits drops below the dew point.

Depending upon the extremity of the temperature differential between the air emitted from the primary air conduit and the secondary air conduit and the velocity of such air, then the insulating member should either extend into the grid member or need only be in contact with the grid member. In the display case where there is only a partial secondary air conduit, i.e. the secondary air conduit only extends part of the way around the cabinet, the temperature differential between the air emitted from the two conduits tends to be much lower. In addition, in the display case with the partial secondary air conduit the speed of the air emitted from the secondary air conduit is lower and hence does not extract as much heat. For these reasons, there is less of a tendency for any buildup of condensation on the grid member although such tendency does still exist. Accordingly, the insulating member need only be in contact with the grid member and need not extend into the grid member.

Where there is a secondary air conduit that extends around the entire cabinet, the temperature differential of the air emitted from the two conduits is generally greater and the speed of the air emitted from the secondary air conduit is also higher. In such an embodiment, there is a greater tendency for a buildup of condensation on the grid member. Thus, in order to eliminate such condensation buildup, the insulating member should extend a significant distance into the grid member although not entirely through the grid member. This distance is approximately $\frac{2}{3}$ to $\frac{3}{4}$ of the thickness of the grid member. The actual extent, however, largely depends on the particular parameters of the display case and hence are subject to modification.

DESCRIPTION OF THE PREFERRED EMBODIMENTS

Figure 1:
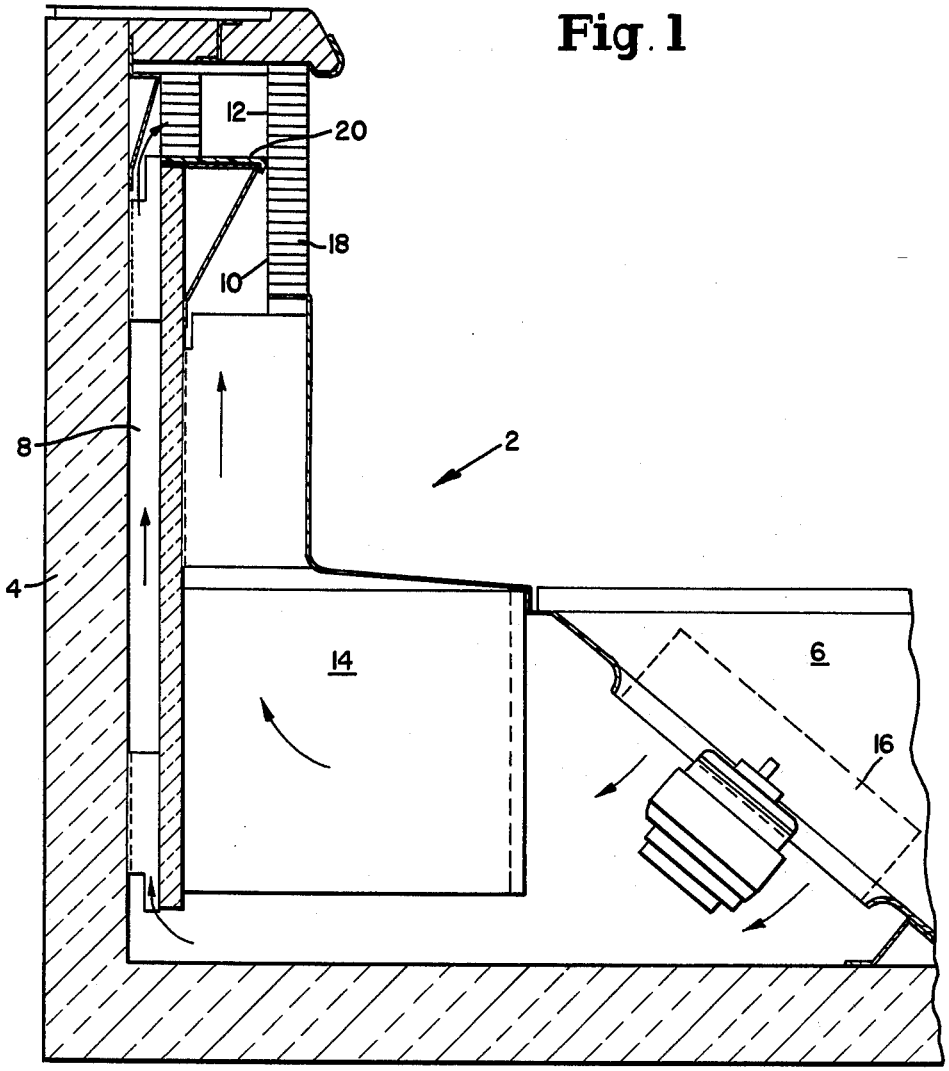
FIG. 1 is a cross-sectional view of a portion of a refrigerated display case in accordance with a first embodiment of the present invention.

FIG. 1 illustrates a portion of an open top refrigerated display case 2. Display case 2 is formed by a cabinet 4 having an interior display space and an access opening at its top. Extending around cabinet 4 is a primary air conduit 6 through which the air to be refrigerated is circulated. Surrounding a portion of conduit 6 is a secondary air conduit 8. In the particular illustrated embodiment, secondary air conduit 8 only extends along a portion of display case 2. In an alternative embodiment, secondary conduit 8 can extend entirely around the cabinet in the same manner as primary conduit 6.

Conduit 6 has an outlet opening 10 for emitting air across the access opening in the top of the display case. Such air travels across the access opening and is received by an inlet opening at the opposite end of the conduit and located on the other side of the access opening. Conduit 8 has an outlet opening 12 which also emits air across the access opening. The air leaving outlet opening 12 is received by the inlet opening for conduit 6.

Air is circulated through conduit 6 and conduit 8 by a fan 16. In actuality, there can be a plurality of fans extending along the lateral width of the display case. The majority of the air leaving fan 16 passes through a set of evaporator coils 14, but a portion of the air passes under the evaporator coils into conduit 8. The air passing through evaporator coils 14 is refrigerated and then emitted through outlet opening 10.

Extending across outlet openings 10 and 12 is a single unitary grid member 18. Grid member 18 has a plurality of openings which can be formed in a honeycomb structure. In order to minimize condensation on grid 18, an insulating member 20 is in contact with the grid member.

Insulating member 20 can be formed by sheet metal plate surrounded by a layer of insulation on both sides. The insulation can be a polystyrene plastic material such as ephafoam.

The air emitted through opening 10 during the refrigeration operation of the display case is typically on the order of between 20° and 30° F. for a medium temperature display case. The air emitted through outlet opening 12, in a medium temperature display case, is typically on the order of between 30° and 40° F. Thus, approximately a 10° temperature differential exists between the air emitted from the two air conduits.

Figure 2:
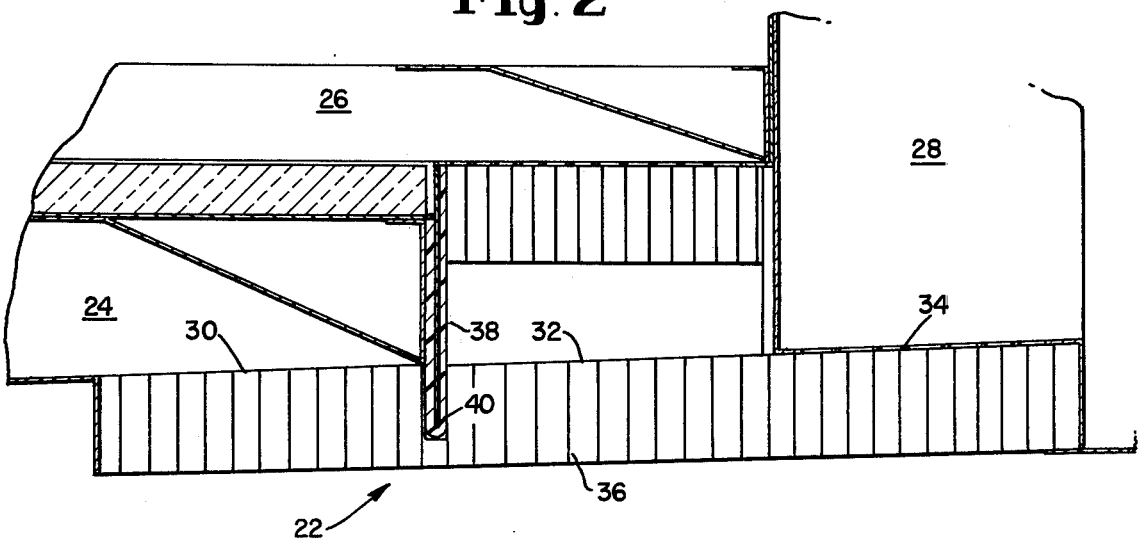
FIG. 2 is a cross-sectional view of a portion of a second embodiment in accordance with the present invention.

An alternative embodiment of the invention is illustrated in FIG. 2. This figure shows a top portion 22 of an open front refrigerated display case. Extending around the display case is a primary air conduit 24 and a secondary air conduit 26. There also can be an optional tertiary, ambient air conduit 28. The primary air conduit has an outlet opening 30, the secondary air conduit an outlet opening 32 and the tertiary air conduit an outlet opening 34. A unitary grid member 36 extend across all three outlet openings. This grid member has a plurality of openings therein, which can be in a honeycomb formation, for enabling the air to pass through the grid. An insulating member 38 separates the primary and secondary air conduits in the area of the outlet openings. Insulating member 38 has a lower portion 40 which extends into but not entirely through grid member 36. This insulating member is formed by a sheet metal plate which is covered on both sides by an insulating material. Alternatively, the insulating member can be formed by a solid piece of insulating plastic.

Typically during operation of a medium temperature display case, the air emitted from the outlet opening of the primary air conduit will be between 20° and 35° F. The air emitted from the secondary air conduit during the typical operation of the medium temperature display case will be between 45° and 55° F. Normally the temperature differential between the air emitted from the two conduits is approximately 20° F. In a freezer display case, either open front or open top, with a full secondary air conduit, the temperature of the air emitted from the primary air conduit would be on the order of −20° F. and the temperature of the air emitted from the secondary air conduit would be on the order of 25° F. Thus, the freeze case has a temperature differential of 45° F.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefor intended to be embraced therein.

We claim:

1. A refrigerated display case comprising:

a cabinet with an interior display space for holding refrigerated products, said cabinet having an access opening therein enabling access to the products within said interior display space;

a primary air conduit encircling said cabinet and having an outlet opening at one end adjacent to said access opening and an inlet opening at its other end adjacent to said access opening and said inlet and outlet openings being aligned so that air leaving said outlet opening is directed across said access opening of said cabinet and received by said inlet opening;

refrigeration means arranged in said primary air conduit for refrigerating air passing through said primary air conduit;

means for circulating air through said primary air conduit;

a secondary air conduit extending along said cabinet and positioned outside of said primary air conduit, said secondary air conduit having an outlet opening for directing air across said access opening of said cabinet and said outlet opening of said secondary air conduit being aligned with and positioned adjacent to said outlet opening of said primary air conduit;

a unitary grid member extending across said outlet opening of said primary air conduit and said outlet opening of said secondary air conduit, said grid member having a plurality of parallel air outlet channels; and, thermal insulating means for separating said outlet opening of said primary air conduit and said outlet opening of said secondary air conduit and contacting said unitary grid for thermally isolating said outlet openings for minimizing condensation in the area of the intersection of said outlet opening of said primary air conduit and said outlet opening of said secondary air conduit due to the differential in the temperature of the air emitted from said outlet openings, said insulating means serving to sufficiently minimize condensation for avoiding frost build-up free of the application of heat supplied by using electrical heater wires, said insulating means including an insulating member formed by a sheet metal plate covered on both sides with an insulating material such as a flexible rubber based insulation with the thickness of said insulating material being approximately between $\frac{1}{8}''$ and $\frac{1}{4}''$ on each side of said metal plate.

2. A refrigerated display case according to claim 1 wherein said insulating member extends into but not entirely through said unitary grid.

3. A refrigerated display case according to claim 2 wherein said insulating member sufficiently isolates the two portion of said unitary grid for substantially eliminating condensation when the temperature differential between the air leaving said outlet opening of said primary air conduit and the air leaving said outlet opening of said secondary conduit is greater than approximately 20° F.

4. A refrigerated display case according to claim 3 wherein during the operation of said refrigerated display case, the temperature at the outlet opening of said primary air conduit is between 20° and 35° F. and the temperature at the outlet opening of said secondary air conduit is between 45° and 55° F.

5. A display case according to claim 1 wherein said insulating member that separates said outlet opening of said primary air conduit and said outlet opening of said secondary air conduit and is in contact with said unitary grid.

6. A refrigerated display case according to claim 5 wherein during operation, the temperature differential of the air emitted from said outlet opening of said primary air conduit and said outlet opening of said secondary air conduit is approximately 10° F.

7. A refrigerated display case according to claim 6 wherein during operation, the temperature of the air emitted from said outlet opening of said primary air conduit is between 20° and 30° F. and the temperature of the air emitted from said outlet opening of said secondary air conduit is between 30° and 40° F.

8. A refrigerated display case according to claim 1 further comprising an ambient air conduit having an outlet opening and said unitary grid extends across said outlet opening of said ambient air conduit.

* * * * *